US006865915B2

(12) United States Patent
Ugalde Blanco

(10) Patent No.: US 6,865,915 B2
(45) Date of Patent: Mar. 15, 2005

(54) INTERNAL LOCK

(75) Inventor: Emilio Ugalde Blanco, Mungia (ES)

(73) Assignee: Baussa Export, S.A., Mungia (ES)

( * ) Notice: Subject to any disclaimer, the term of this patent is extended or adjusted under 35 U.S.C. 154(b) by 0 days.

(21) Appl. No.: 10/333,219

(22) PCT Filed: Dec. 26, 2001

(86) PCT No.: PCT/ES01/00505

§ 371 (c)(1),
(2), (4) Date: Jan. 21, 2003

(87) PCT Pub. No.: WO02/075086

PCT Pub. Date: Sep. 26, 2002

(65) Prior Publication Data

US 2003/0167808 A1 Sep. 11, 2003

(30) Foreign Application Priority Data

Mar. 20, 2001 (ES) ..... 2000100641

(51) Int. Cl.[7] ..... E05B 47/06

(52) U.S. Cl. ..... 70/278.7; 70/279.1; 70/280; 292/142; 292/144

(58) Field of Search ..... 70/280–283, 278.7, 70/279.1; 292/142, 144

(56) References Cited

U.S. PATENT DOCUMENTS

| | | | | | |
|---|---|---|---|---|---|
| 6,112,563 | A | * | 9/2000 | Ramos | 70/278.1 |
| 6,282,931 | B1 | * | 9/2001 | Padiak et al. | 70/279.1 |
| 6,406,072 | B1 | * | 6/2002 | Chen | 292/144 |
| 6,502,438 | B1 | * | 1/2003 | Miller et al. | 70/303 A |
| 6,585,302 | B2 | * | 7/2003 | Lin | 292/142 |
| 6,591,643 | B1 | * | 7/2003 | Cannella et al. | 70/277 |
| 2001/0029760 | A1 | * | 10/2001 | Viney | 70/279.1 |
| 2002/0062670 | A1 | * | 5/2002 | Doong | 70/279.1 |
| 2002/0125724 | A1 | * | 9/2002 | Doong | 292/144 |

* cited by examiner

*Primary Examiner*—Lloyd A. Gall
(74) *Attorney, Agent, or Firm*—Browdy and Neimark, P.L.L.C.

(57) ABSTRACT

An internal lock (E) for safes and similar applications, with an outer console (A) that includes software with the instructions required by the user, which is connected by that passes through the wall of the safe to the lock. The latter includes a printed circuit linked to the one in the console and is operated by a power supply (D) connected to the mains. A simple mechanism composed of a latch (5), a motor (7), gears and a trigger are responsible for the operation of the latch, in accordance with the orders received.

5 Claims, 7 Drawing Sheets

5/7

INTERNAL LOCK

This invention relates to an internal lock located inside a safe, for instance, which is operated from the exterior by means of a console, which includes the corresponding printed circuit that permits the controlled opening of the above-mentioned safe.

The console in question enables the programming of the different opening sequences for the lock, and it is in this sense a conventional item, which is connected by means of wiring to the said lock. The wiring passes through the wall of the safe in question to the lock.

In the interior of the lock is a printed circuit, connected to the corresponding printed circuit in the console, so that the orders from the latter are transmitted to the lock through the aforesaid wiring.

In this conventional technique, in which different practical solutions are known, the operation of the internal lock is usually carried out by means of different kinds of batteries, which provide the necessary voltage for the appropriate of the internal lock.

On the other hand, the mechanisms that form the internal lock itself are usually complex and of a general design which requires a large number of components, a reason why they do not offer high reliability in their operation.

The main objective of the invention is to provide an internal lock which is operated directly from the mains supply through a power supply unit connected to the mains supply and which, moreover, has an extremely simple and highly reliable mechanism.

In order to achieve this objective, the invention presents a casing, with a box base or main body and a lid, suitably secured to each other, in order to form a hollow internal space, in which the mechanisms are housed.

When they are connected to each other, the lid and the box base have an open side space for the entry of two connectors, one of which comes from the console and the other from the power supply unit connected to the mains supply.

One of the two connectors is connected to the printed circuit housed inside the body of the lock, while the other is connected to a small motor, also housed inside the said body of the lock.

In the same way, another opening is provided between the lid and the box base for the possible exit of a latch that forms part of the internal mechanisms, and in which this latch enters or leaves a housing -ad hoc- for the closure or opening of the lock.

The lid is situated just above the printed circuit board, below which there is a support plate, which has two large holes in its surface.

In one of these holes is housed a portion of the body of the lock latch, and in the other there is a portion of the electric motor that causes the movement of the latch.

The body of the latch has a longitudinal protruding portion, which is received in one of the holes in the support. This portion is hollow and has a cylindrical interior that receives a spring provided with two free ends, with this spring moving in this said interior and along a channel or slot which is a prolongation of the said hole.

One of the said ends of the spring is secured to a hole cut in the support plate itself, and the other to the inner end of the previously mentioned hollow in which it is housed, by means of the provision of a suitable pin.

The longitudinal protruding portion remains housed in the hole in the support plate, also with a certain longitudinal adjustment, which acts as a guide for the latch, and the hollow is of a longer length than that of the said protruding portion, in order to allow the play of the said latch inside the support plate.

Due to the effect of the spring, the body of the latch remains in a situation of contact with one of the ends of the hole in the support plate and away from the other end of the said hole. This situation of contact corresponds with the greatest outward protrusion of the latch from the surface of the support plate, i.e. with the normal position of the latch, protruding in a direction towards the corresponding recess of the safe, leaving the unit in the closed position.

This natural protrusion is reached through the hole or space prepared in the body of the lock, as stated previously.

The plan view of the lock is rectangular and both the opening for the passage of the latch to the exterior and the opening for the entry of the connectors are provided in the shorter sides of the lock casing.

The support plate that holds the latch is also included inside a theoretical rectangular plan view, with the hole for the longitudinal rib of the latch, close to one of its shorter ends.

The longitudinal rib of the latch protrudes towards the printed circuit board and is provided with a small ledge or rib, which in movements of the latch passes between two pairs of photo-electric detectors of the said printed circuit board, for the purposes that will be explained later.

The portion of the latch below the support plate has an end in terms of the latch itself, an adjacent portion with an upward surface cavity and a This downward end rib remains almost vertical to the small upper ledge or rib to connect with the detectors, forming a transversal, vertical and rear wall.

The rib is displaced towards one side in relation to a central longitudinal plane of the latch, and a wide side recess cut in the side of the latch, where this vertical rib ends.

As stated previously, the portion by way of the latch itself remains in a direction towards the exterior of the support plate, and the other end with the hollow longitudinal portion with the spring and the vertical rib are situated towards the interior of the said support plate.

Below this unit, composed of the support plate and latch body, is situated a set of gears operated by the motor and a trigger, which are in charge of causing the movement of the latch.

At this point it is advisable to remember what was stated previously, in the sense that the latch is to be found in its natural extended state due to the action of the spring, closed, so that the concealment or moving back of this latch by means of the lower mechanisms will correspond with the lock open position.

The drive motor that receives voltage from the power supply unit connected to the mains supply by means of the connector, is situated transversally in relation to the body of the latch and properly positioned between a seating that provides a cavity in the casing of the body of the lock and the other opening in the support box.

The shaft takeoff of this motor includes a helical gear that turns in an anticlockwise direction, transmitting this turning to other intermediate gears secured inside the casing or box, until it causes a main crown gear to turn, in a higher position and close to the body of the latch. The centre of this crown gear is contained in the vertical plane followed by the upper longitudinal rib on the body of the latch.

Two lugs protrude out from the upper face of this crown gear, one of which is arranged closer to its centre, whereas the other, more distant, is displaced at a certain angle from the former in an anticlockwise direction.

On the other hand, on the base of the casing for the lock and in a side position outside the vertical of the body of the lock, a trigger obliged in turning by a spring is secured, which due to the continuous action of the said spring turns in the direction so as to fit into the side recess in the side of the body of the latch. This trigger has a end mounted on a shaft that starts form the base of the casing for the lock and another rounded end which is housed in the side recess of the latch and is capable of being contacted by the more outer lug on the previously mentioned toothed crown gear.

Thus, when the latch is in the natural protruding position, i.e. lock closed, the motor is at rest, and the trigger with one free end housed in the recess in the side of the body of the latch, it immobilises the latter.

The turning of the motor when it is activated, in accordance with the orders received through the electronic circuit, causes the upper crown gear to turn anticlockwise. At the start of this movement, the lug farther from the centre of the crown gear approaches the trigger, in such a way that it makes contact with its free end and it moves it back from contact with the body of the latch, maintaining this contact for a certain period of time.

When the trigger has been moved back, the other lug closer to the centre of the toothed crown gear makes physical contact with the rear vertical wall of the body of the latch, just at its start towards the longitudinal centre of the said body.

On continuing to turn, the more distant lug obliges the trigger outwards and the lug closer to the centre slides along the rear vertical transversal wall of the body of the latch, obliging it to move towards the interior of the body of the lock, with which the latch separates from its housing in the safe and the lock becomes open.

The continuation of the turning of the motor, when this is ordered, makes the two lugs lose contact with the trigger and with the body of the latch, with which the trigger returns to its position and the body of the latch, obliged by the spring, moves towards the exterior again, with the end of the trigger entering once again into the recess in the side of the body of the latch.

In the movements of the latch, the small projection on the body of the latch, that protrudes from the protruding longitudinal portion that receives the spring, remains in the interior of the two pairs of photoelectric detectors of the upper printed circuit board of the lock, which detect and control the movements of the body of the latch.

A seismic detector is also situated inside the box or casing, received in its housing in the base of the body of the lock, which is activated on noticing the presence of movements, blows, etc. and giving the corresponding warning signal.

The unit includes a battery to replace the possible lack of electric power supply from the mains supply, on account of blackouts or breakdowns, so that the continuous operation of the system is guaranteed.

The accompanying sheets of drawings show the unit of the invention and its most important details, with the following being represented:

Figure 1:
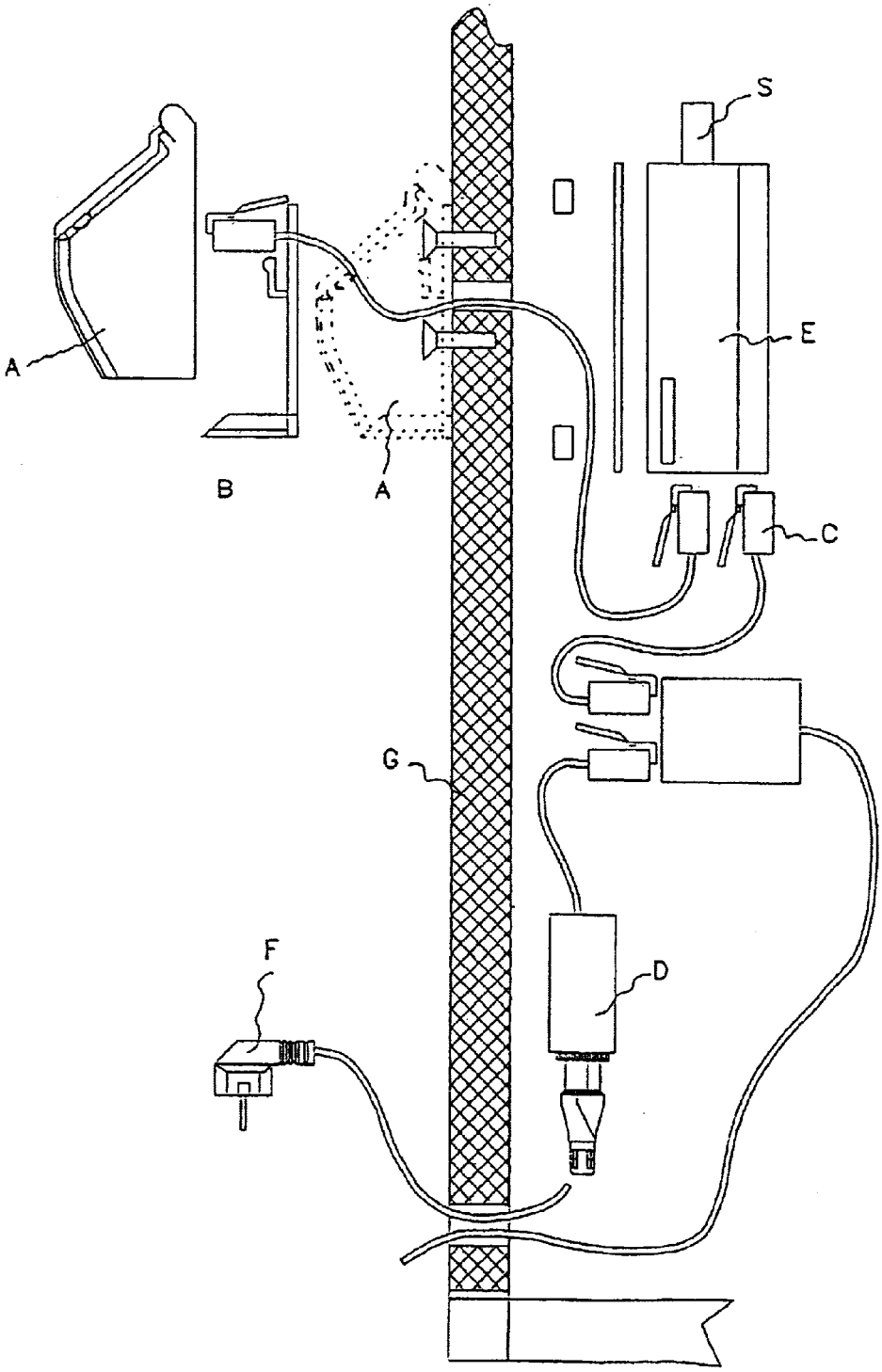
FIG. 1 is a representation that reflects the location of the internal lock system.

With regard to FIG. 1, we emphasise the exterior position of the command console (A), which includes a support base (B) for its correct positioning, in accordance with (A'), against the wall (G) of the safe to be controlled. Some wiring passes through the said wall until it reaches the lock (E), housed in the interior, by means of a connector. At the same time, the casing or box has a wire passing through it, which is connected to the mains supply by means of the plug (F), providing current to a power supply unit (D), in turn connected to the lock by means of the connector (C).

The lock (E) receives orders from the exterior console, which contains all the software needed in order to carry out the relevant sequences that the user requires: delayed opening, codes and passwords, opening, closing, etc.

The latch of the lock (E) is housed in the proximity of the door of the safe, carrying out its classic opening or closing function in relation to a corresponding female portion.

Figure 2:
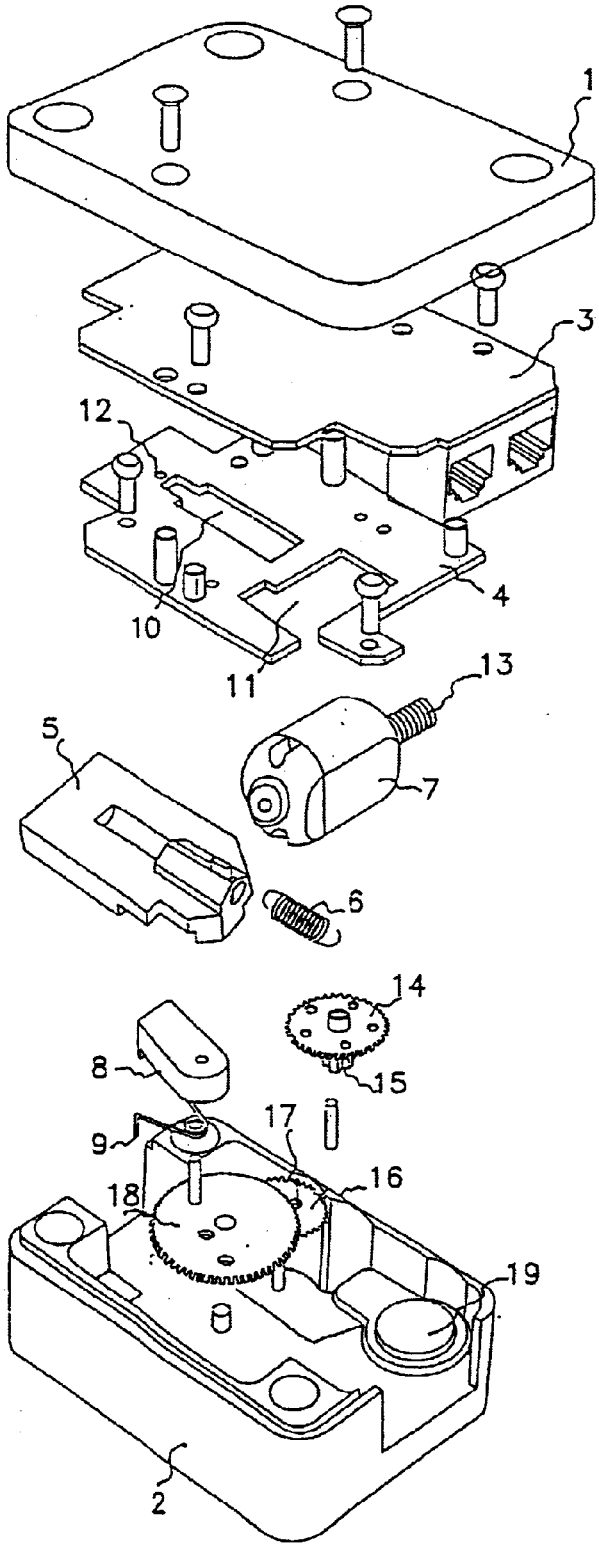
FIG. 2 is a perspective that represents the set of internal components of the lock.

The mechanisms of the lock, in accordance with FIG. 2, are contained in the casing (2) for the lock and the lid (1) to close this casing, leaving free spaces for the passage of the latch and for the two electrical connectors that come from the exterior. From top to bottom, we can observe the interior printed circuit board (3) with its photosensors 51, the support plate (4) with its holes or openings (10) for the latch (5) and (11) for the motor (7).

We can also observe the spring (6) that controls the position of the body of the latch (5), the side trigger (8) with its corresponding spring (9) and the set of gears (14, 15, 16, 17, 18), which are operated by the gear (13) on the motor takeoff shaft (7).

In the casing or box (2), a seismic detector (19) is also located, connected to the wiring, in the same way as the motor (7) and the printed circuit board (3).

All the items are perfectly secured to this interior of the casing by means of holes. Bolts or screws, recesses, ribs, etc., which are represented but not numbered.

Figure 3:
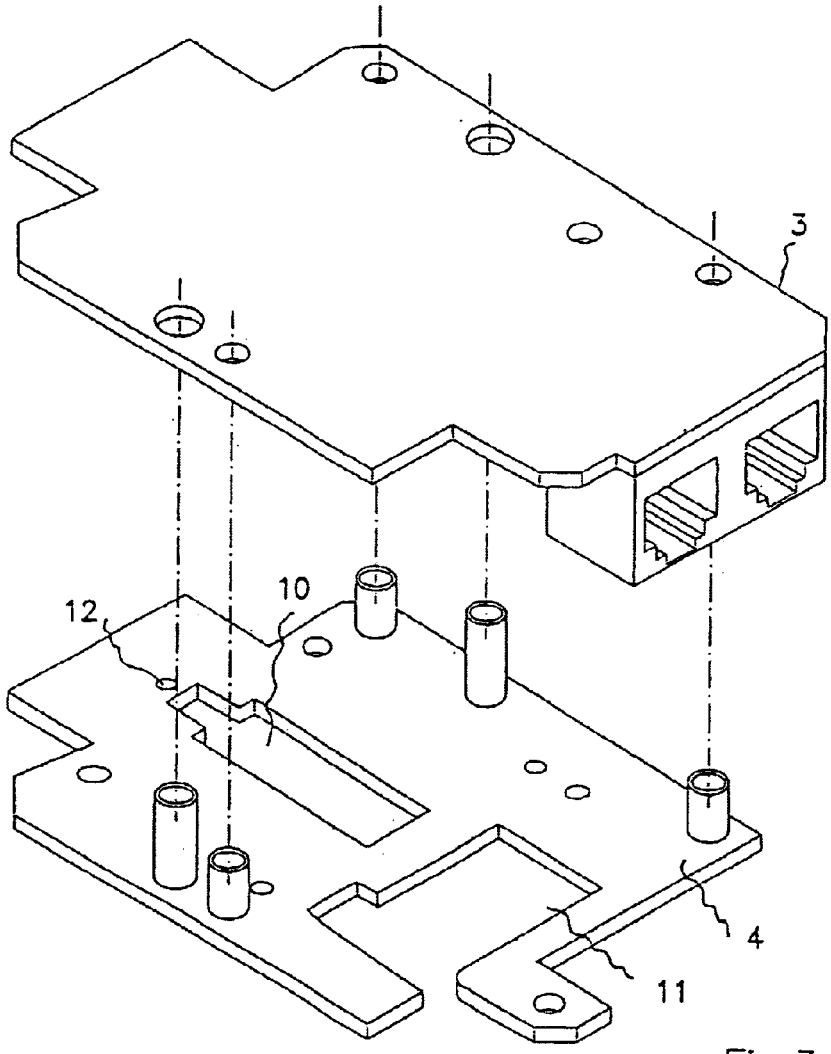
FIG. 3 is an enlarged perspective showing the printed circuit board and the support plate in two views, front and rear.

The body of the latch has a specific end which will extend towards the left of the position of the plate (4). This plate, as well as the one that forms the printed circuit board (3) are defined in FIG. 3, in which it is possible to appreciate the hole (12) for fixing one of the ends of the spring (6) that causes the transfer movement of the body of the latch (5).

Figure 4:
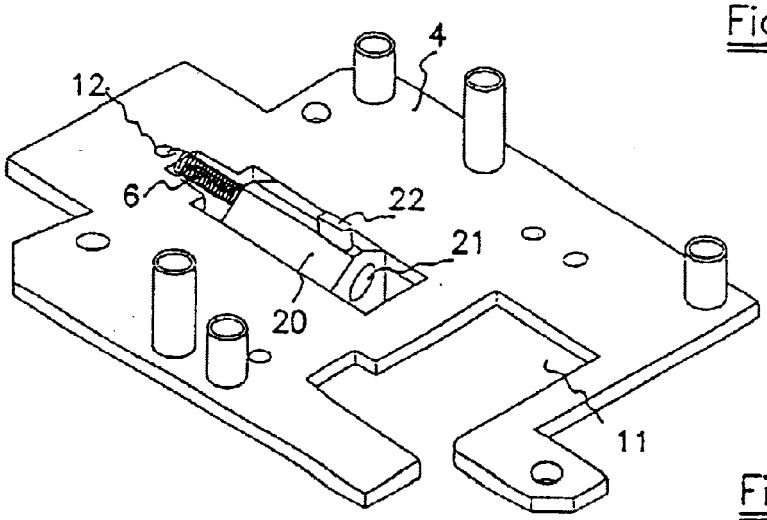
FIG. 4 shows the support plate with the body of the latch mounted on it.

In accordance with FIG. 4, we see how the longitudinal projection (20) of the latch (5) fits into the opening (10) in the support plate (4) with the spring (6) included in the hollow in the projection (20) and connected to the hole (12) by one of its ends and to the pin (21) with its other end.

The latch is obliged at all times by the spring (6) in the sense of leaving the end of the said latch protruding, i.e. keeping the lock closed.

Figure 5:
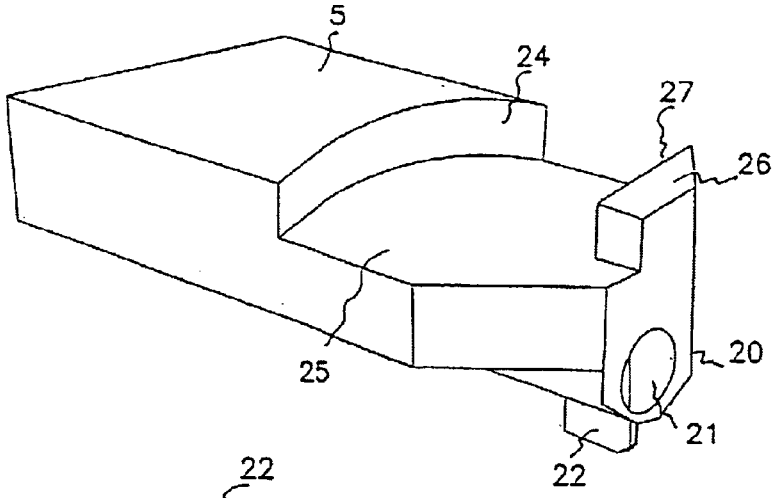
FIGS. 5, 6 and 7 are three perspective views that show the body of the latch, in accordance with the invention.
Figure 6:
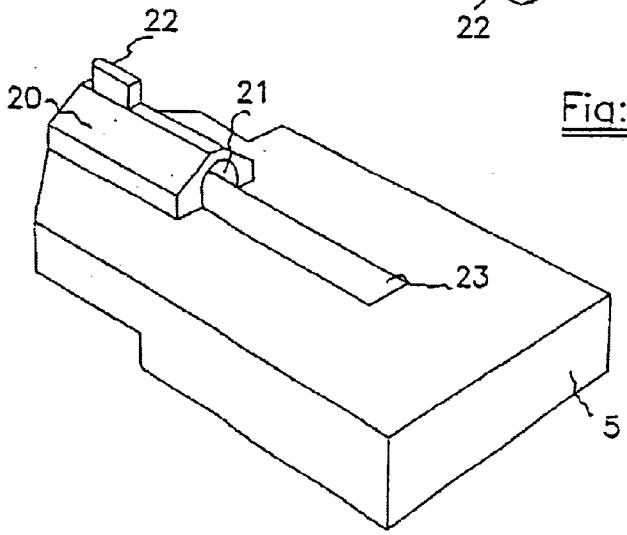
Figure 7:
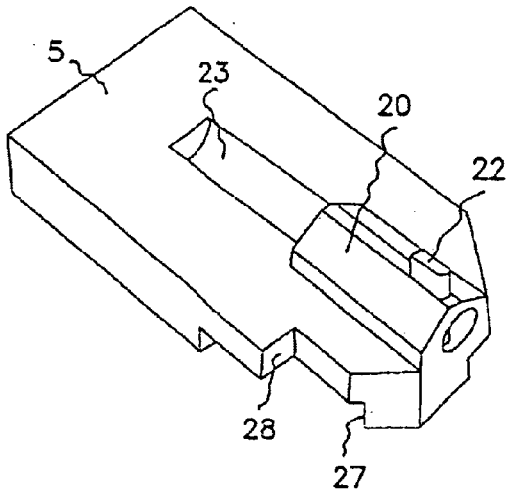

The body of the latch in FIGS. 5, 6 and 7 shows perfectly its shape and details. Thus, in FIG. 6, one can appreciate the longitudinal protection (20) that receives the spring, the channel (23) for the seating of the spring in its extension and the upper rib (22) for the passage between the two pairs of detectors on the printed circuit board (3).

The other top view of the latch, FIG. 7, allows us to appreciate the side recess (28) in which the trigger (8) will be housed, as will be explained later.

The bottom view of FIG. 5 allows us to observe the cavity (24, 25) that determines the vertical rib (26), which provides, at its rear, a transversal vertical wall (27), on which one of the lugs on the upper toothed crown gear (18) will slide. It will be appreciated that the vertical rib (26) is offset in relation to the longitudinal projection (20).

The lug on the toothed crown gear (18) will make contact on this wall (27) from the left, in accordance with the position shown in FIG. 5, travelling along the said surface until it reaches the opposite end, where the contact is released.

Figure 8:
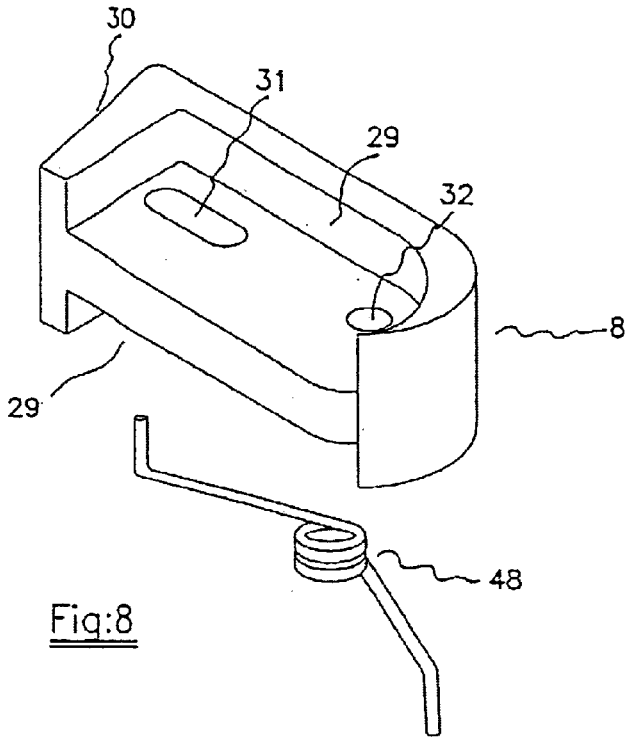
FIG. 8 represents a perspective of the trigger with the spring.

The trigger (8) in FIG. 8, has its particular shape, with a hole (32) for the passage of a shaft housed in the base of the casing (2), with the spring (48) being secured to this shaft. This spring has two arms or wings, one of which is secured to a blind hole in the base of the casing, while the other passes through the cutout (31) with the corresponding play.

The two arms of this spring are perfectly controlled by the vertical inner wall (29) of the trigger, providing a continuous tendency to keep this trigger with its end (30) in direction towards the side recess (28) of the latch (5) in order to maintain it in the closed position. Previously, it will be on the rounded end (30) that one of the lugs on the toothed crown gear will make contact for its withdrawal, in relation to the latch.

Figure 9:
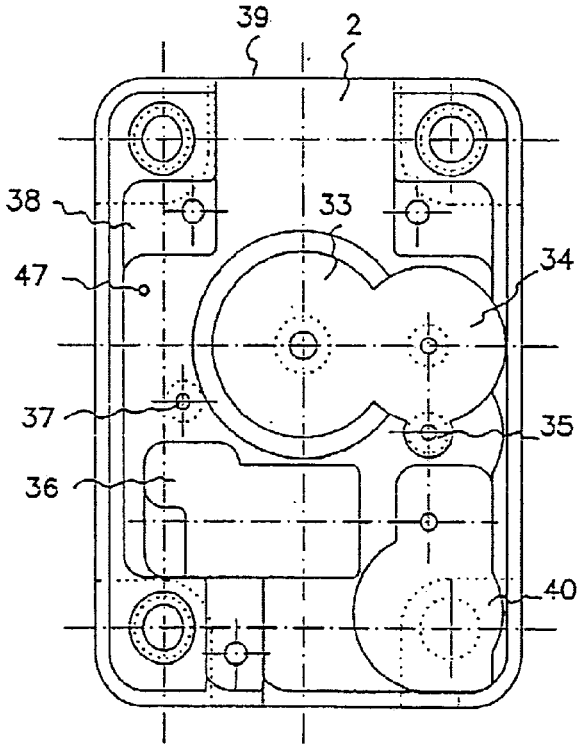
FIG. 9 is a plan view of the box or casing for the lock.

From FIG. 9, we cain highlight the body (2) of the lock, that shows the opening (39) for the passage of the latch; the blind recess (36) for the seating of the motor; the blind recess (40) for the seismic detector; a wall (38) that provides a rear space in which the trigger is located, with the hole (37) with the turning shaft, and the hole (47) for the arm of the trigger.

Figure 11:
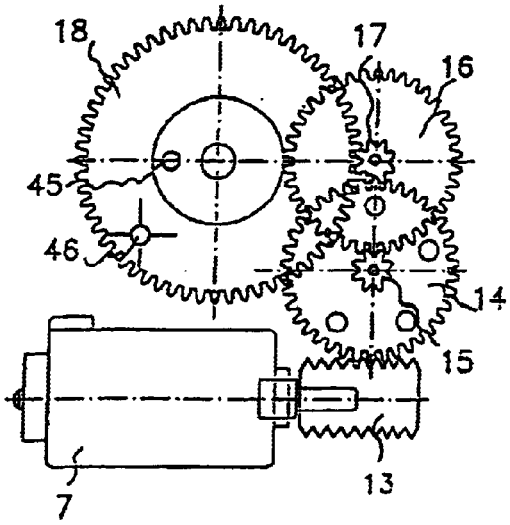
FIG. 11 represents the gear train with the motor.

In the cavities (33, 34, 35), which are also blind, the different components of the gear train shown in FIG. 11 are housed at different levels, either directly or by means of lugs.

From the helical gear (13) that comes from the motor (7), the crown gear (14) and pinion (15), mounted in the position (35) in FIG. 9, are made to turn. The pinion (15) engages with the crown gear (16) and pinion (17), mounted in the position (34) in FIG. 9, and the pinion (17) transmits the turning to the toothed crown gear (18), that remains at a certain height above this system, occupying the position (33) determined in FIG. 9.

In these two FIGS. 9 and 11, we can observe how the centre of the toothed crown gear (18) will remain aligned with the longitudinal axial shaft of the position to be occupied by the latch (5), as well as the two lugs (45), for the movement of the said latch, and (46) displaced in an anticlockwise direction in relation to the former, in order to make contact with the end (30) of the trigger (8) and displace it.

Figure 10:
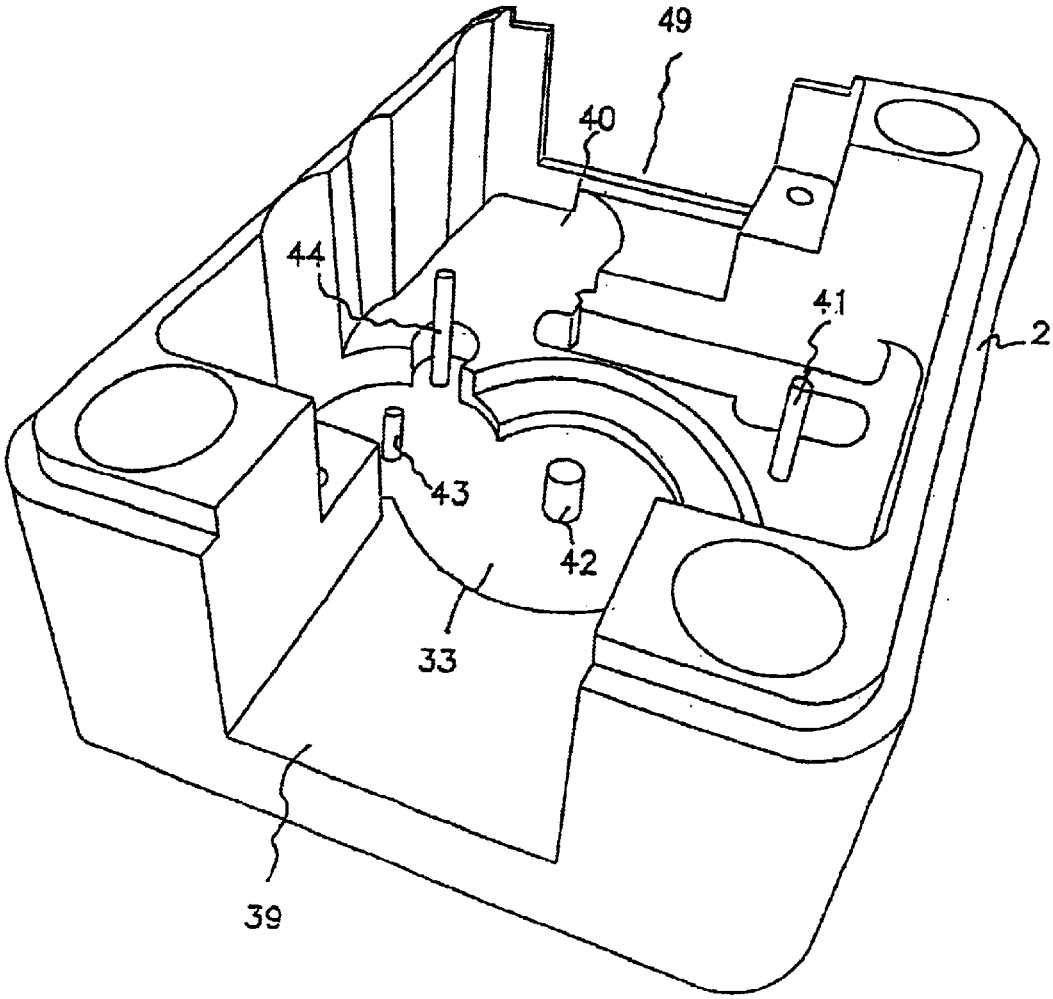
FIG. 10 is a perspective of the box or casing for the lock.
Figure 12:
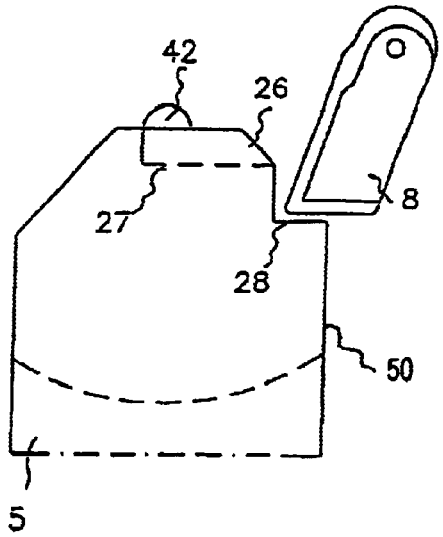
FIGS. 12, 13 and 14 show three different positions of the operation of the latch and trigger in their relation with the lugs on the upper toothed crown gear of the gear train.

FIG. 10 enables us to have total understanding of the relative positioning of the different items in the casing (2), appreciating the opening (39) for the latch; the position (40) for the seismic detector; the opening (49) for the entry of the connectors (C): the central lug (42) for the gear (I 8); the lug (41) for the triggar (8); the lug (43) for the gear-pinion (16–17) and the lug (44) for the gear-pinion (14–15). From FIG. 12 we can appreciate how when the latch is protruding, in the unit closed position, the trigger keeps it controlled by means of its recess in the side (28) of the wall (50) of the latch (5).

Figure 13:
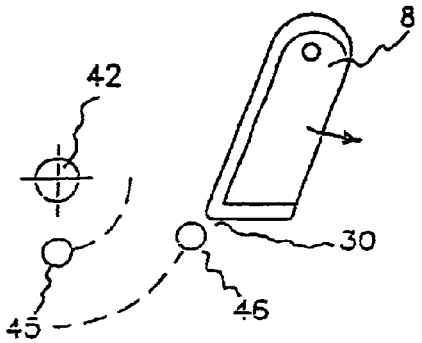

When the crown gear (18) begins to turn to the left, FIG. 13, the lug (46) is on the point of making contact with the end (30) of the trigger (8) in order to start to withdraw it as indicated by the arrow. At the same time, the lug (45) is already in a position to support itself on the rear surface (27) of the vertical rib (26) on the latch.

Figure 14:
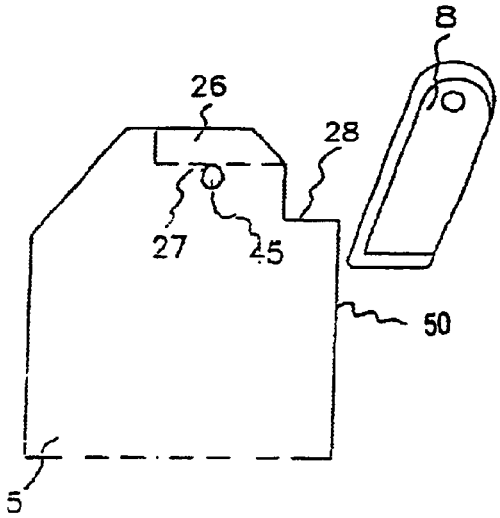

On continuing to turn, FIG. 14, the trigger is already withdrawn, and the circular movement of the lug (45) on its shaft (42) makes it travel along the surface (27) and displace the latch a certain amount until it is withdrawn or moved back sufficiently to open the lock.

Once open and if turning continues, the lug leaves its contact with the wall (27) with which the spring of the latch makes the latch return to its initial position and the trigger (8) one again immobilises it.

As stated previously, the lock is very simple to operate, it is easy and economical to produce and, above all, it offers extraordinary reliability for the purposes proposed.

What is claimed is:

1. Internal lock device, suitable for safes and similar applications, with the lock (E) in the interior of the said safe (G) and with a external console (A, B) from which the lock (E) is controlled, with wires that pass through the wall of the safe (G) for the console-lock (A, E) intercommunication, so as to place a latch (5) of the lock in either a protruding or concealed relative position, and with the lock being composed of a casing (2) and a lid (1) that provide open spaces (49, 39) to the exterior for the passage of the connectors and with the latch being equipped with a motor (7), which is characterised by:

a power supply unit (D) adapted to be housed in the interior of a safe and which is connected by wiring to the exterior and the mains supply and by means of a connector feeds current directly to the lock, an electric circuit mounted on a board (3) housed in the interior of the lock, with two inputs for the connectors from the exterior console (A, B) and from the power supply unit (D), with this circuit making internal contact with the motor (7) and with a seismic sensor module (19) also housed inside the lock casing and with the board also having two photo-electric sensors (51) aligned in the direction of the movement of the latch (5), a support (4) by way of a plate that has two holes or openings, one (10) for the insertion of a portion of the latch (5) and the other (11) for the seating of the body of the motor (7), while also having a small hole (12) for the fixing of a spring (6) that provides the movement to the said latch, the latch (5) has a protruding longitudinal portion (20) at the side of the opening (10) in the support (4), with this latch being partially housed in this opening, with this protruding portion being hollow and circular in its interior (21), in order to receive the spring (6), which becomes fixed by one end to an internal pin and by the other to the hole (12) in the support (4), in which the interior hollow or cavity (21) is prolonged into a channel (23) in order to support the spring in the latch protruding position, with the forward end of the projection (20) also including a small rib or ledge (22) that passes, in its movements, between two pairs of photo-electric detectors (51) on the printed circuit board (3), a lower portion of the latch (5) with a cavity (24, 25) of a certain height, between its free end and its forward portion, with a vertical rib (26) on this forward portion occupying a relative position below the projection (20), in which this vertical rib does not range from side to side at the front of the part and provides a rear transversal vertical surface (27), having a side recess (28) at the end of this surface and at the side of the latch, the motor (7) is supported at its lower end in a cavity in the base of the casing (2) for the lock and whose shaft takeoff includes a helical gear (13) that turns in an anticlockwise direction, through which it is in connection with other intermediate gears, up to a main crown gear (18) housed in another cavity in the base of the casing (2), in which the centre of this crown gear (18) is contained in the theoretical longitudinal central line followed by the upper projection (20) on the latch (5) in its movements, two upwardly protruding lugs (45, 46) from the surface or face of the crown gear (18), of which one (45) is in a certain proximity to its centre, whereas the other (46) is farther from the centre and displaced a certain angle in an anticlockwise direction in relation to the former, a trigger (8) mounted in rotation on a shaft (41) protruding from the base of the casing (2) and distant from the centre of the crown gear, in which this trigger is obliged by a spring (48) towards the centre of the crown gear and towards the latch (5) that remains supported on the casing (2) above the said crown gear, the trigger (8) has, at the opposite end from the turning end (32) a rounded area (30) by which it is capable of being housed in the side recess (28) on the latch (5) when the latter is extended, immobilising it, or otherwise being contacted by the outermost lug (46) on the crown gear (18) when this turns, in order to withdraw from the said recess and remain withdrawn for a certain period of time, the lug (45) close to the centre of the crown gear is supported on the vertical surface (27) of the vertical rib (26) on the latch (5) when this latch is extended and when the crown gear and the lug (45) turn, this lug moves the latch inwards, by sliding it along the surface (27) until it loses contact with it and the spring (6) of the latch again acts and again extends the latch.

2. Internal lock device, in accordance with claim 1, characterised in that the elements ordered, from top to bottom, as follows: on the lid (1), the upper printed circuit board (3), the support (4), the latch (5), and the gear train or gear set and trigger below the latch.

3. Internal lock device, in accordance with claim 1, characterised in that as the length of the opening (10) in the support is longer than the length of the protruding portion (20) of the latch, this portion protrudes upwards from the support, whereas the rest of the latch protrudes downwards.

4. Internal lock device, in accordance with claim 1, characterised in that the set of gears or gear train, to be connected between the lead gear (13) from the motor and the final crown gear (18), is composed of a counterclockwise turning helical crown gear provided with an interlocked pinion (15), which is connected with another toothed crown gear (16) with its pinion (17), which is engaged to the crown gear (18) and makes it turn.

5. Internal lock device, in accordance with claim 1, characterised in that the spring (48) of the trigger has two arms or wings, an upward one, which is received in a cutout (31) in the trigger and a downward one, which is housed in a blind hole in the base of the casing (2), with the body of the said spring being controlled in a groove (29) in the trigger.

* * * * *